United States Patent [19]

Chioffe

[11] Patent Number: 4,688,400

[45] Date of Patent: Aug. 25, 1987

[54] EARRING BACK DEVICE

[75] Inventor: Joseph J. Chioffe, North Bellmore, N.Y.

[73] Assignee: Montclair Jewelry Corporation, Manhasset, N.Y.

[21] Appl. No.: 808,165

[22] Filed: Dec. 12, 1985

[51] Int. Cl.[4] ..... A44C 7/00

[52] U.S. Cl. ..... 63/12; D11/43

[58] Field of Search ..... 63/12, 13; D11/42, 43

[56] References Cited

U.S. PATENT DOCUMENTS

| | | | |
|---|---|---|---|
| 3,945,089 | 3/1976 | Gagnon | 63/12 |
| 4,086,786 | 5/1978 | Ritter | 63/13 |
| 4,218,894 | 8/1980 | Tropea | 63/13 |

FOREIGN PATENT DOCUMENTS

| | | | |
|---|---|---|---|
| 653960 | 11/1928 | France | 63/13 |

*Primary Examiner*—Richard J. Johnson

*Attorney, Agent, or Firm*—Lilling & Greenspan

[57] ABSTRACT

An earring back device consisting of a back clutch movably attached to a bridge mechanism whose ends are inserted into an ornament holder. The ends of the bridge mechanism are inserted through two peripheral channels in the back clutch enabling the clutch to be moved up and down on the bridge mechanism to adjust the distance between the back clutch and the ornament holder, so that a wearer may place the ornament holder in a desired position at the base of her ear lobe.

1 Claim, 13 Drawing Figures

FIG. 1
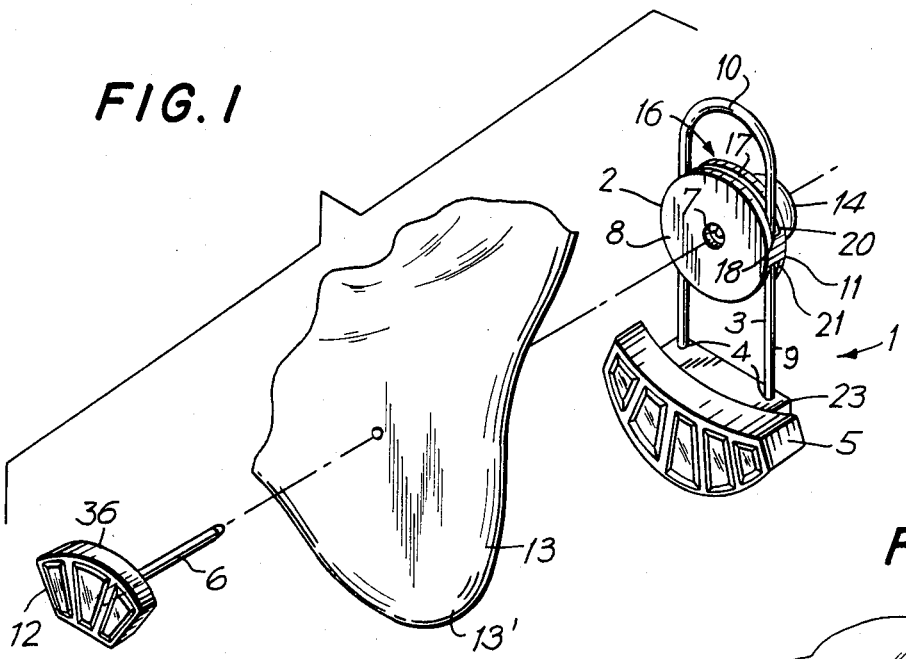
FIG. 2
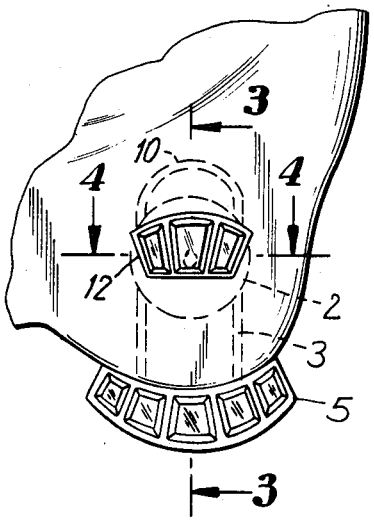
FIG. 3
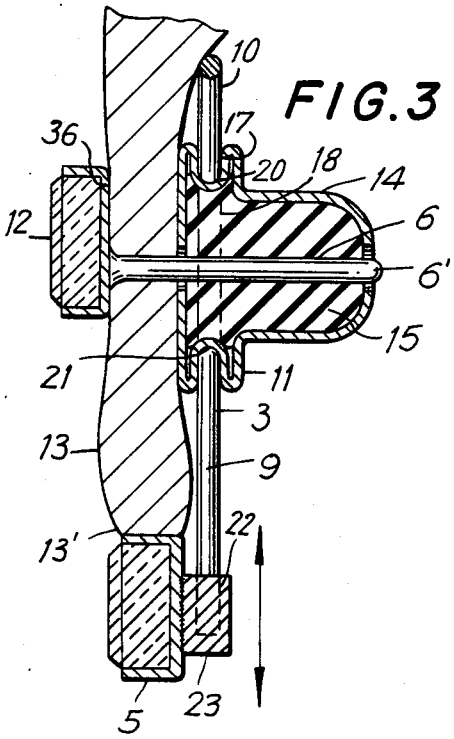
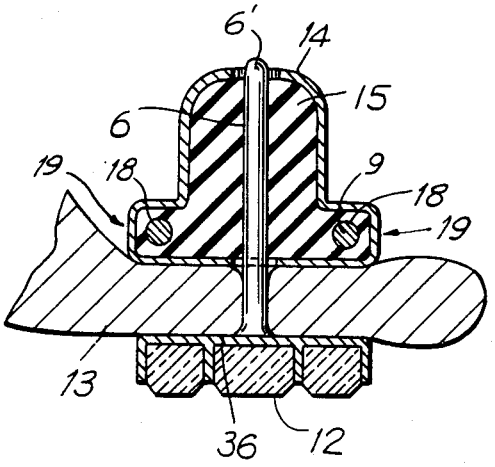
FIG. 4

EARRING BACK DEVICE

BACKGROUND OF THE INVENTION

In recent years it has become increasingly more popular for members of both sexes to wear two or more earrings in or on their ear lobes. In order to achieve this fashion look, many people have had to continually pierce new openings in the lobes. A side effect of this continued piercing is not only additional pain to the earring wearer, but also the appearance of unsightly openings in the wearer's ear lobes should the person decide to forego the multiple earring look or should fashion change. Furthermore, pierced earrings have traditionally been held in a wearer's ear lobe by means of an earring back whose only function was to hold the earring post in place in the ear.

Thus, the need has existed for an improved means of achieving the multiple ornament fashion look without the accumulation of many pierced earring openings. It is an object of this invention to achieve a multiple earring appearance without the necessity of a multitude of earring backs, by using a single opening pierced through the wearer's ear lobe.

SUMMARY OF THE INVENTION

Applicant's invention is an earring back device which consists of a back clutch movably attached to a bridge mechanism, whose ends are inserted into an ornament holder. The back clutch has an opening through which an earring post inserted through an ear lobe travels and two peripheral channels through which the ends of the bridge mechanism are inserted. By this arrangement, the back clutch may slide up and down along the bridge mechanism to modify the distance between the opening in the clutch and the ornament holder, so that the wearer may place the ornament holder in a desired position regardless of the size of the ear lobe.

BRIEF DESCRIPTION OF THE DRAWINGS

FIG. 1 is an exploded perspective view of the earring back device with a disk clutch.

FIG. 2 is a front view of the earring back device in place on a wearer's ear, illustrating the bridge mechanism and disk clutch in phantom lines.

FIG. 3 is a cross-sectional view taken along lines 3—3 of FIG. 2.

FIG. 4 is a cross-sectional view taken along lines 4—4 of FIG. 2.

DETAILED DESCRIPTION OF THE INVENTION

Figure 5:
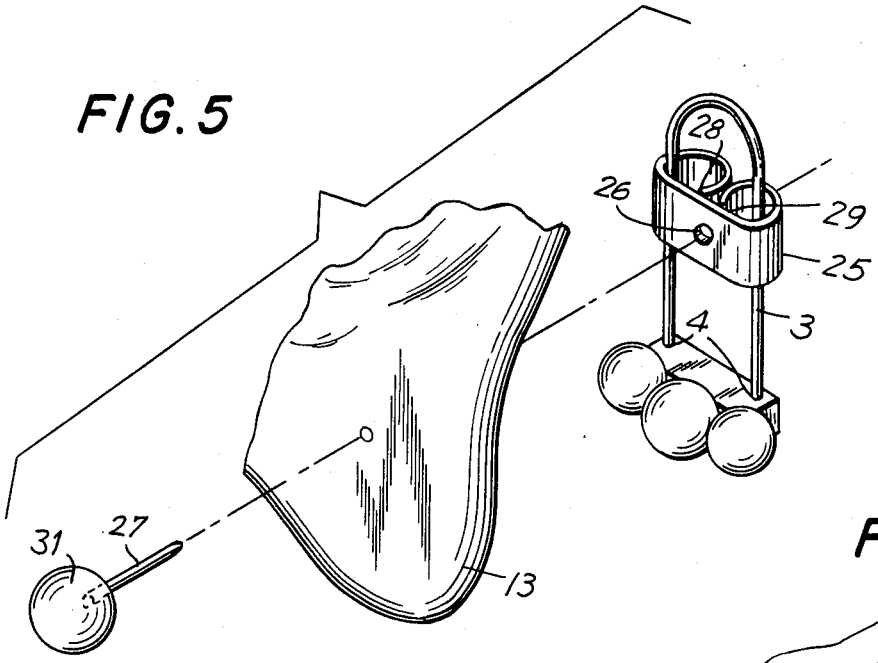
FIG. 5 is an exploded perspective view of a second embodiment of the earring back device having a friction clutch back.

The earring back device 1 consists fundamentally of a back clutch 2 movably attached to a bridge mechanism 3, having two ends 4 which are inserted into an ornament holder 5. It may be appreciated that the invention may be used either with a pierced earring having a friction post 6 or with an earring attached to an ear lobe by means of an adhesive. Thus, the design of the earring back device 1 may contain an opening 7 through the back clutch 2 to accommodate the friction post 6 of a pierced earring or it may be made with a solid face side 8 to accommodate an adhesive to be used with a stick-on earring.

The earring back device 1 may be made from any suitable material, preferably a gold or metal compound.

It may further be appreciated that the design of the invention may be of any type desired. One preferable embodiment is illustrated in FIG. 1 as having a disk back clutch 2 movably attached to a bridge mechanism 3. The bridge mechanism 3 may be made of a spring wire 9 bent to form a top curve 10 in a U-shape. In other embodiments, the bridge mechanism 3 may be bent into a smaller top curve 10 to accommodate a smaller disk back clutch 2 or with a squared top portion of the bridge mechanism 3 for a different design look. The bridge mechanism 3 may be made of any material which can be bent to accommodate a back clutch.

As illustrated in FIG. 1, the disk back clutch 2 has an opening 7 in its face side 8 extending through it to a back side 11. This opening 7 accommodates the friction post 6 of a front ornament holder 12 which is extended through a wearer's ear lobe 13 and into the opening 7.

In the preferred embodiment, the back side 11 of the disk back clutch 2 is elongated to form a knob 14 through which the opening 7 is extended. Further in the preferred embodiment, the disk back clutch 2 is filled with a friction holding material 15, such as teflon, plastic, rubber, etc. as shown in cross section in FIGS. 3 and 4. This material 15 aids in holding the friction post 6 in place in the disk back clutch 2 without slippage.

Along a top portion 16 of the disk back clutch 2 is a groove 17 ending in two peripheral channels 18 extending through either side 19 of the disk back clutch 2. The groove 17 may be of any desired size and shape, however, in the preferred embodiment the size and shape of the groove 17 is slightly larger than that of the top curve 10 of the bridge mechanism 13. In this design, when the disk back clutch 2 is slid toward the top curve 10 of the bridge mechanism 3, it may be concealed inside the groove 17 for a more pleasing appearance.

The peripheral channels 18 open into the groove 17 on one end 20 of the channels 18 and have a second opening 21 at their bottom end as illustrated in FIGS. 1 and 3.

Although the channels 18 may have any diameter desired, the preferred diameter is slightly larger than the diameter of the spring wire 9 forming the bridge mechanism 3. In this design, the ends 4 of the spring wire 9 may be inserted through the channels 18 in a manner allowing the disk back clutch 2 to slide easily up and down along the bridge mechanism 3.

The ends 4 of the bridge mechanism 3 are attached to a back ornament holder 5. In a preferred design, the spring wire 9 is removably inserted into tracks 22 in a back portion 23 of the back ornament holder 5. In this design, the spring wire ends 4 are curved away from each other and are pressed together and inserted into the tracks 22. The curved ends 4 spring apart once inserted into the tracks 22 to hold the bridge mechanism 3 in the back ornament holder 5. Since the bridge mechanism 3 may be removably inserted into the back ornament holder 5, a wearer may exchange bridge mechanisms 3 among various pairs of earrings to achieve a variety of earring looks.

Figure 9:
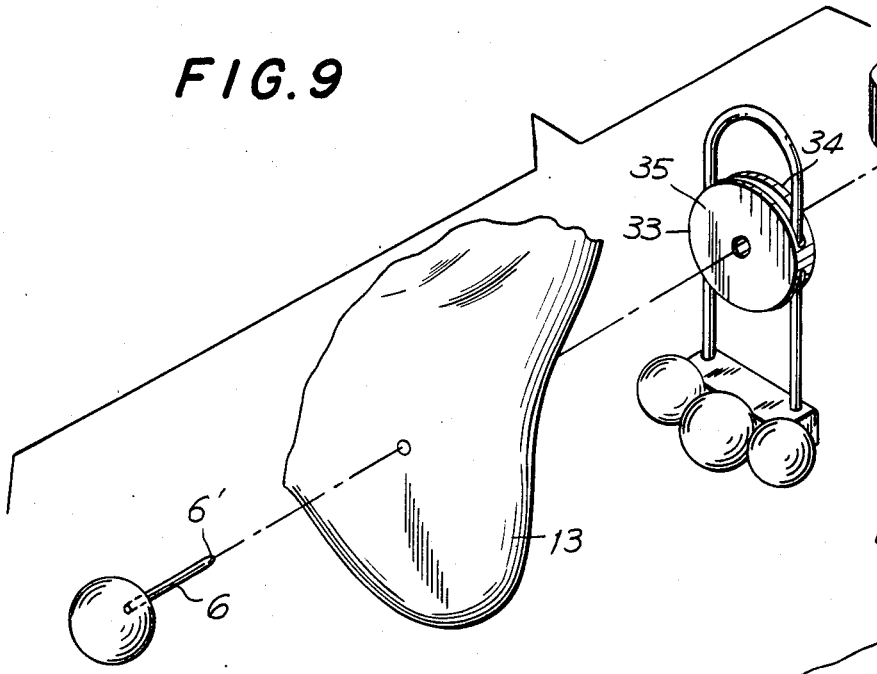
FIG. 9 is an exploded perspective view of the earring back device having both a disk clutch and a friction clutch.
Figure 9:
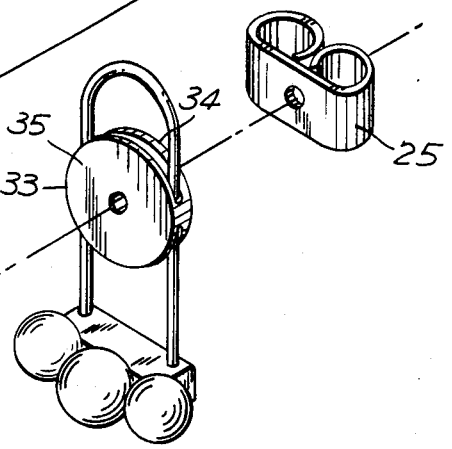

The back ornament holder 5 may be designed to hold any type or shape of jewel or ornament that is desired. For fashion coordination, a front ornament holder 12 may be manufactured with a friction post 6 to hold jewels or ornaments which correspond in type or shape to those held in the back ornament holder 5 as illustrated in FIGS. 1, 5 and 9.

The appearance of the front ornament holder 12 coupled with the earring back device 1 having the back ornament holder 5 is illustrated in a front view in FIG. 2 on the wearer's ear 13. The disk back clutch 2 and bridge mechanism 3 are shown in phantom lines.

As the shape of every person's ear lobe 13 varies, the result of sliding the back clutch along the bridge mechanism 3 is to allow a wearer to adjust the back ornament holder 5 to a position at the base 13' of his or her ear lobe 13. Thus, a wearer with a larger ear lobe 13 may push the disk back clutch 2 closer to the top curve 10 of the bridge mechanism 3 as illustrated in FIG. 2, whereas a wearer with a smaller ear lobe 13 may push the back clutch 2 in a direction closer to the back ornament holder 5.

Figure 13:
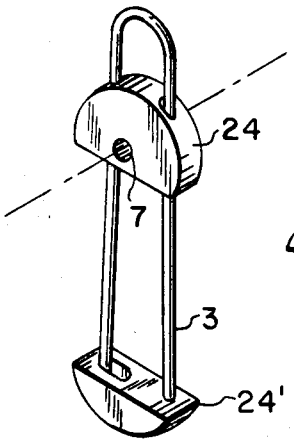
FIG. 13 is a perspective view showing an alternate embodiment of the back clutch as shown in FIGS. 1-4.

The positioning of the opening 7 in the center of the disk back clutch 2 determines where the back clutch needs to be positioned on the bridge mechanism in order to cradle the back ornament holder 5 at the base 13' of the wearer's ear lobe 13. Therefore, if the opening 7 is placed nearer a circumference of the back clutch rather than at its center, the distance between the back clutch 2 and the back ornament 5 would have to be adjusted by the wearer. In one preferred embodiment, the disk back clutch 2 is divided into two halves 24, 24' with the uppermost half 24 having the opening 7 inserted through it. In this design, the bottom half 24' is permanently attached to the back ornament holder 5 and only the upper portion 24 of the disk back clutch 2 slides along the bridge mechanism 3 as illustrated in FIG. 13.

FIGS. 5–8 illustrate a second embodiment of a back clutch used on the bridge mechanism 3. In FIG. 5, a friction back clutch 25 is illustrated having a central opening 26 to accommodate a friction post 27 of a pierced earring.

Further, the friction back clutch 25 is made of a metal material whose ends 28 can be bent toward a back side 29 of the friction back clutch 25. When the ends 28 of the back clutch 25 are bent, loops 30 are formed through which the ends 4 of the bridge mechanism 3 are inserted. Thus, the loops 30 serve as the channels of the back clutch 25 in a manner similar to the channels 18 of the back clutch 2. In this design, the friction back clutch 25 may move up and down along the sides of the bridge mechanism 3 to adjust the distance between the central opening 26 of the friction back clutch 25 and the back ornament holder 5.

Figure 8:
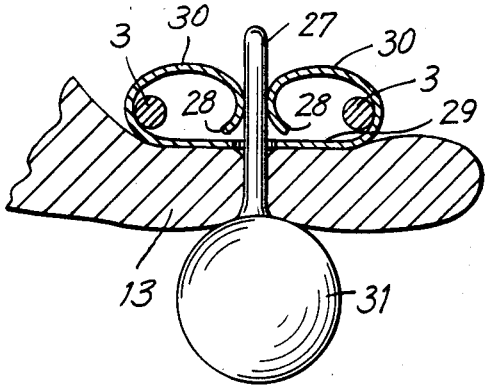
FIG. 8 is a cross-sectional view taken along lines 8—8 of FIG. 6.

Curving of the ends 4 of the friction back clutch 25 to form loops 30 further prevents it from slipping off the bridge mechanism 3 as indicated in cross-section in FIG. 8.

The preferred embodiment of the earring back device 1 may be designed with the ends 4 of the bridge mechanism 3 removably inserted into the back ornament holder 5 as described above.

Figure 6:
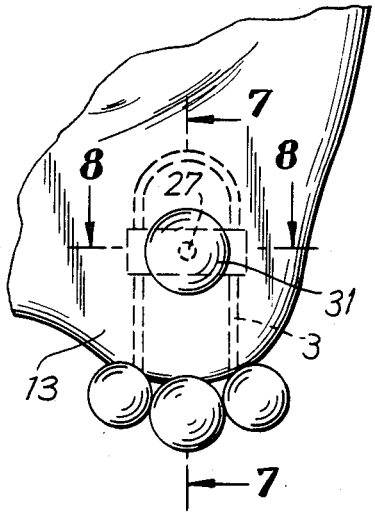
FIG. 6 is a front view of the earring back device shown on a wearer's ear lobe illustrating the bridge device and friction clutch back in phantom lines.
Figure 7:
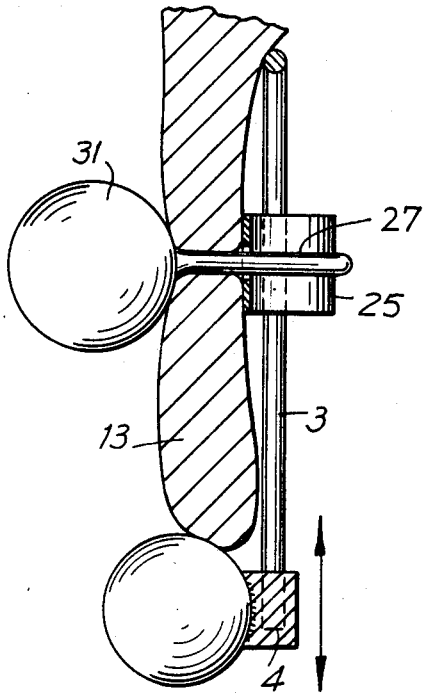
FIG. 7 is a cross-sectional view taken along lines 7—7 of FIG. 6.

The appearance of a front ornament 31 with a friction post 27 inserted through a wearer's ear 13 and into the opening 26 of the friction back clutch 25 is shown in a front view in FIG. 6. The friction back clutch 25 and the bridge mechanism 3 are shown in phantom lines.

Figure 10:
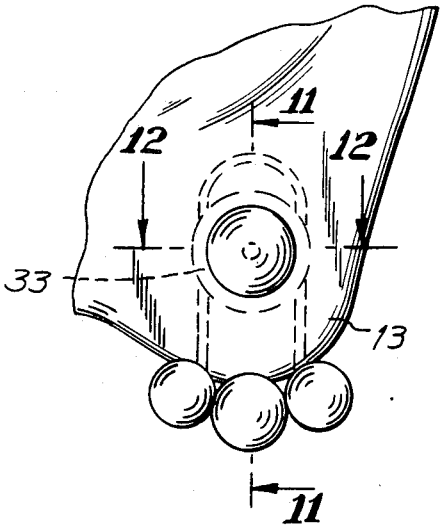
FIG. 10 is a front view of the earring back device shown on a wearer's ear lobe illustrating the bridge mechanism, the disk clutch and the friction back clutch in phantom lines.
Figure 11:
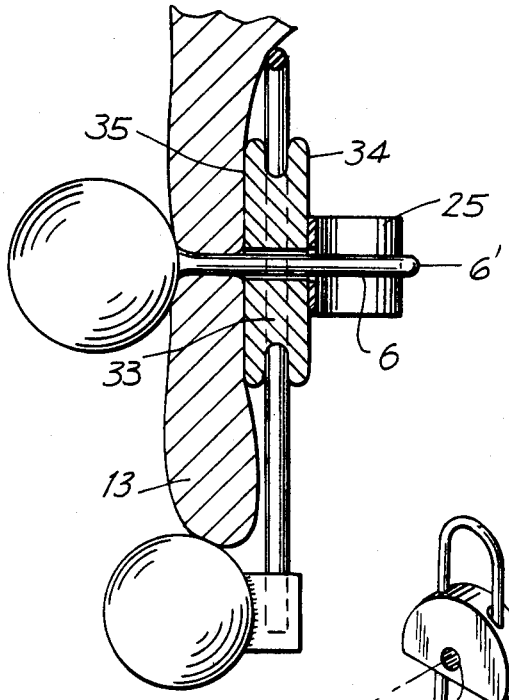
FIG. 11 is a cross-sectional view taken along lines 11—11 of FIG. 10.
Figure 12:
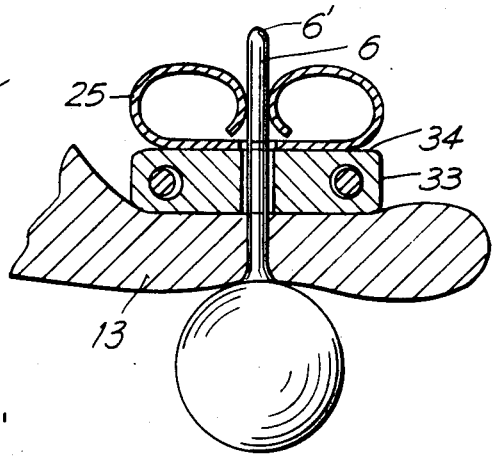
FIG. 12 is a cross-sectional view taken along lines 12—12 of FIG. 10.

Another embodiment of the invention is shown in FIGS. 9–12. In FIG. 9, a disk back clutch 33 is illustrated as having a flattened back side 34, as well as, a flattened front side 35. This design allows the user to insert a pierced earrring's friction post 6 through the ear lobe 13 and into the disk back clutch 33. Subsequently, the user may insert a friction back clutch 25 onto the end 6' of the friction post 6 to additionally aid in holding the pierced earring in place on the wearer's ear 13 as shown in FIGS. 11 and 12. Further, the use of a friction back clutch 25 with a disk back clutch 33 may eliminate the need for manufacturing the disk back clutch 33 with friction holding material 15 inside to thus reduce the cost of manufacturing and to provide a more versatile earring back.

The disk back clutch 33 may also be coupled with a screw-on back clutch, rather than a friction back clutch 25. In such an embodiment the end 6' of the friction post 6 would be grooved to screw into a threaded opening in the screw-on back clutch, thus ensuring a secure fit.

The design of the earring back device 1 does not alter the appearance of the back ornament holder 5 when used with a front ornament holder 12 or pierced earring as illustrated in FIGS. 2, 6, and 10. The preferred design embodiment of the invention is dependent on the user's manufacturing resources and design preferences.

Further, the inventive device 1,may be used with a front ornament holder 12 having adhesive on its back side 36 to be used on a non-pierced ear lobe. In this embodiment, the back clutch would not have an opening through it but rather would have adhesive placed on its front side to adhere the device to the back of the ear lobe. This design permits a wearer who does not wish to pierce his ears, to achieve a multiple earring look by sliding the back clutch 2 along the bridge mechanism 3 and thus adjust a back ornament holder 5 at the proper position at the base 13' of the ear lobe 13.

I claim:

1. An earring back device comprising:

a first ornament holder having a friction post;

a back clutch accommodating and holding said friction post of said first ornament holder;

a bridge mechanism consisting of a bent spring wire having a U-shape, and long ends of said bent spring wire passing through channels on each side of said back clutch, and said back clutch being movable along said bent spring wire of said bridge mechanism; and a second ornament holder connected to the ends of said bent spring wire.

* * * * *